US006991498B2

(12) United States Patent
Wertz et al.

(10) Patent No.: US 6,991,498 B2
(45) Date of Patent: Jan. 31, 2006

(54) SPRING CONTACT FOR CONNECTORS

(75) Inventors: Darrell Lynn Wertz, York, PA (US); Philip Clay Brandberg, Carlisle, PA (US); Brent David Yohn, Newport, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/946,198

(22) Filed: Sep. 21, 2004

(65) Prior Publication Data

US 2005/0042939 A1 Feb. 24, 2005

Related U.S. Application Data

(63) Continuation of application No. 09/747,608, filed on Dec. 22, 2000, now Pat. No. 6,802,748.

(51) Int. Cl.
*H01R 4/48* (2006.01)

(52) U.S. Cl. ..... 439/830

(58) Field of Classification Search ..... 434/830, 434/856, 857, 855, 851, 852, 853, 854, 858, 434/842, 751, 861, 862, 771, 499, 492, 493
See application file for complete search history.

(56) References Cited

U.S. PATENT DOCUMENTS 3,838,388 A * 9/1974 Bauerle et al. ..... 439/857
4,232,931 A * 11/1980 Takeuchi et al. ..... 439/857
5,399,108 A * 3/1995 Lu et al. ..... 439/682

* cited by examiner

*Primary Examiner*—Ross Gushi
(74) *Attorney, Agent, or Firm*—RatnerPrestia

(57) ABSTRACT

A spring contact design used to connect varied electrical components to circuit boards such that the components may be installed onto the board and thereafter removed without soldering and desoldering of the component leads is disclosed. The inventive contacts use integral flexible elements and appropriate contact element shaping to ensure solid multiple electrical connection points between the contact and the electrical component lead. With the use of the inventive spring contacts, components may be easily installed onto a circuit board and tested to ensure functional performance and, if necessary, may be removed or replaced without the need for time consuming soldering and desoldering of the component leads to the board contacts. The inventive contacts are designed to ensure sound electrical connection with component leads of different cross sections, shapes and sizes. Use of the inventive contacts in housings sized and shaped for different electrical components are also disclosed.

12 Claims, 12 Drawing Sheets

Fig. 13 (6)

SPRING CONTACT FOR CONNECTORS

CROSS REFERENCE TO RELATED APPLICATION

This application is a continuation of U.S. application Ser. No. 09/747,608, filed Dec. 22, 2000, now U.S. pat. No. 6,802,748.

This invention generally relates to electrical component connectors and contacts. More particularly, the present invention relates to an inventive three point contact design that may be used to connect varied electrical components to circuit boards such that the components may be assembled or installed on the circuit board and removed from the board without the need for time consuming soldering and desoldering of the component leads. The inventive contacts use flexible integral spring elements and appropriate contact element shaping to ensure a solid electrical connection between the printed circuit board and the electrical component leads. With the use of the inventive spring contacts, components may be easily installed on a board and tested, and, if necessary, may later be removed or replaced without the need for time consuming soldering and desoldering of the component. The inventive contacts are designed to ensure sound electrical connection with component leads of different cross sections, shapes and sizes.

BACKGROUND DESCRIPTION

As the size of electrical components used in electronic circuitry continues to decrease in size, the density of circuitry placed on printed circuit boards increases. With these two trends, a decrease in overall size and an increase in circuitry density, the value of space or real estate on circuit boards has similarly significantly increased. In addition to the importance and value of space on the board, equally important is need to ensure sound electrical connections between the component leads, which are decreasing in size and structure, and the circuit board.

Another trend in the design and manufacture of circuit boards that kept pace with the complexity and number of circuits and components included on boards, is the need to test, and potentially replace, the fabricated circuits and installed components as they are fabricated or installed on the board and tested. The need to disassemble or replace components on circuit boards has become an important issue. For example, it is inefficient and costly to install a component on a board, to only find out, after the board assembly is complete, that the component is not functionally performing. The time and effort to disassemble, remove and replace the component is expensive and fraught with the potential for creating or causing additional problems in the circuit.

One aspect of this problem is exemplified with electrical components that are installed on a board by soldering of the component leads to the board contacts. The time and effort to install a component, solder the leads to the contacts, test the component and, if the component is not functionally operable, desolder the leads and replace the component is very inefficient and expensive. As noted, in each of the desoldering, disassembly, reassembly and resoldering steps, there is the potential for creating additional problems in the board fabrication.

The current designs for installing electrical components to a board are similar to integrated circuit sockets, where the electrical component leads are bent 90 degrees so that the lead may be inserted into the socket and soldered in place.

Again, the soldering of the leads to ensure a sound electrical connection does not allow for quick or easy disassembly and removal of the component.

Accordingly, there remains a need for a device or contact that allows an electrical component to be easily installed onto a circuit board without the need for solder connections, that ensures sound electrical connections and paths between the component leads and the circuit board, that allows the component to be tested through the board electrical connections, and also allows the component to, if necessary, be easily removed from the board and replaced with the need for desoldering the component leads.

Such a device and contact would greatly increase the efficient assembly and fabrication of circuit boards necessary for mass production of electrical component packages used in various electronic devices.

SUMMARY OF THE INVENTION

In view of the shortcomings of the prior art, it is an object of the present invention to provide an electrical contact that allows an electrical component to be easily and quickly installed on a circuit board and has sound electrical connections between the component and the board without the need for soldering of the component leads to the board contacts. It is a further object of the present invention that the electrical contact allows an electrical component to be easily and quickly removed from a circuit board without the need for desoldering of the component leads or without damaging the board contacts.

To achieve this and other objects, and in view of its purposes, the present invention provides an electrical spring contact for use with varied electrical components, the spring contact comprising a body section, where the body section is attachable at one end to a circuit board; two arms attached to opposite sides of the body section, the two arms defining a separation between the arms; the two arms each having an elbow section extending each arm towards the opposite arm; and a center section attached to the body section between the two arms whereby an electrical component lead can be held by and between, and be in electrical contact with the center section and the two arms.

It is a further object of the present invention to provide an electrical spring contact for use with varied electrical components, the spring contact comprising a body section having a first and second end and two opposing sides, the body section being attachable at the first end to a circuit board; two arms attached to the opposing sides of the body section and extending away from the second end of the body section, the two arms defining a separation between the arms, the arms each having an elbow section such that the separation between the two arms is reduced downstream of the elbow sections; and a center section attached to the body section between the two arms whereby an electrical component lead can be held by and between, and be in electrical contact with the center section and the two arms.

It is a further object of the present invention to provide an electrical spring contact for use with varied electrical components, where the electrical spring contact can hold an electrical component lead having a diameter approximately in the range of 0.010 inches to 0.025 inches.

Another aspect of the present invention is an electrical component assembly, having at least one electrical component, the electrical component having at least one electrical lead, and the connector assembly comprising a housing into which the electrical component fits and is held; and at least one electrical spring contact held within the housing, said electrical spring contact comprising, a body section, the body section being attachable at one end to a circuit board; two arms attached to opposite sides of the body section, the two arms defining a separation therebetween, the arms each having an elbow section extending each arm towards the opposite arm; and a center section attached to the body section between the two arms whereby the at least one electrical component lead can be held by and between, and be in electrical contact with the center section and the two arms.

It is a further object of the present invention to provide an electrical contact assembly, having at least one electrical component, the electrical component having at least one electrical lead, the contact assembly comprising a first housing into which the electrical component fits and is held; a second housing; at least one electrical spring contact seated within the second housing, the electrical spring contact comprising, a body section, the body section being attachable at one end to a circuit board; two arms attached to opposite sides of the body section, the two arms defining a separation therebetween, the arms each having an elbow section extending each arm towards the opposite arm; and a center section attached to the body section between the two arms whereby the at least one electrical component lead can be held by and between, and be in electrical contact with the center section and the two arms.

These and other aspects of the present invention are set forth below with reference to the drawings and the detailed description of certain preferred embodiments. It is to be understood that both the foregoing general description and the following detailed description are exemplary, and are not intended to be or should be considered restrictive of the invention.

BRIEF DESCRIPTION OF THE DRAWINGS

The invention is best understood from the following detailed description when read in connection with the accompanying drawings. It is emphasized that, according to common practice, the various features of the drawing are not to scale. On the contrary, the dimensions of the various features are arbitrarily expanded or reduced for clarity. Included in the drawings are the following Figures:

FIG. 2(*b*) is a side cutaway view of section A—A from FIG. 2(*a*) for an exemplary embodiment of the present inventive three point spring contact;

FIG. 2(*c*) is a side view of an exemplary embodiment of the present inventive three point spring contact;

FIG. 2(*d*) is a partial top view of an exemplary embodiment of the present inventive three point spring contact with a component lead held in place in the spring contact;

FIG. 3(*b*) is a perspective view of an exemplary embodiment of a cover for the FIG. 3(*a*) electrical contact assembly housing;

FIG. 5(*b*) is a side view of an exemplary embodiment of the FIG. 5(*a*) electrical contact assembly housing and a completely mated cover;

FIG. 5(*c*) is a top view of an exemplary embodiment of the FIG. 5(*a*) electrical contact assembly housing and a completely mated cover;

FIG. 8(*b*) is a perspective view of an assembled exemplary embodiments of the present inventive electrical contact assembly housing, with a plurality of three point spring contacts, and covers, with an example laser pump;

FIG. 13(*b*) is a side cutaway view of an exemplary embodiment of the present inventive electrical contact assembly housing with a plurality of the present inventive three point spring contacts, in which an example laser diode is seated and showing a cover section over the spring contacts and laser diode leads;

FIG. 17(*b*) is a bottom perspective view of an exemplary embodiment of the retaining cover shown in FIG. 17(*a*) to hold an electrical component within a component housing;

DETAILED DESCRIPTION OF PREFERRED EMBODIMENTS

The present invention is directed to an electrical contact used to ensure sound electrical connections between an electrical component and a circuit board to which the electrical component is to be assembled. The present invention also is directed to an electrical contact assembly that is to be mounted to a circuit board, where the noted contact is used to make the electrical connection between the electrical component and the circuit board. Example electrical components that the electrical contact may be used with, and which are disclosed in detail herein, include, without limitation, laser pump and laser diodes packages.

The inventive electrical contact has three primary structural elements. The contact elements include a body section, two flexible arms and a center section. The shape and structure of the contact elements is designed such that each contact holds and forms a strong electrical connection with one lead of an electrical component to be assembled on the circuit board. As designed, the arms and center section of the electrical contact provide three separate current paths between the component lead and the circuit board.

Figure 1:
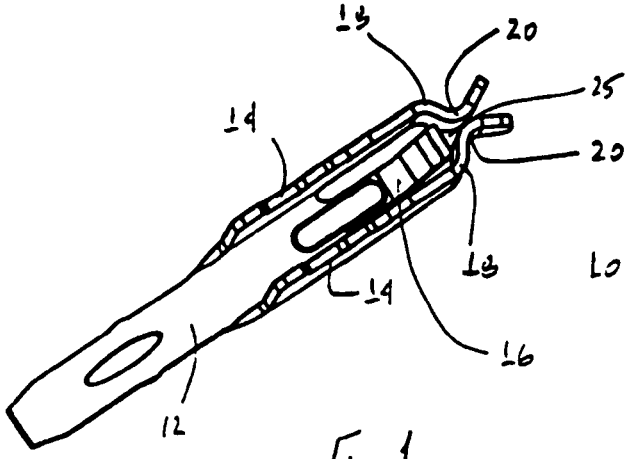
FIG. 1 is a perspective view of an exemplary embodiment of the present inventive three point spring contact.
Figure 2:
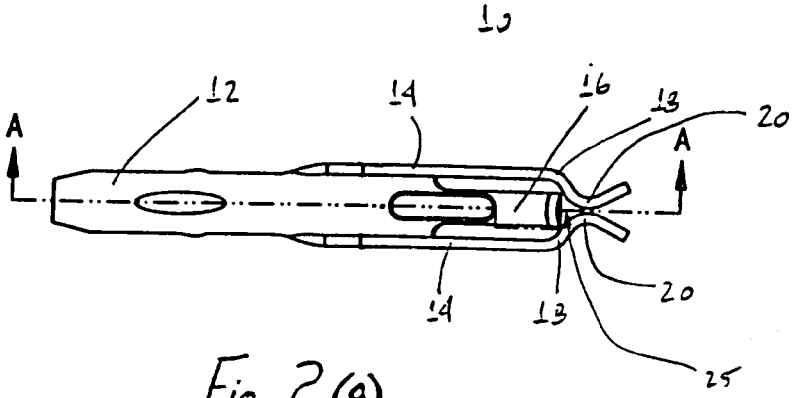
FIG. 2(*a*) is a top view of an exemplary embodiment of the present inventive three point spring contact.
Figure 2:
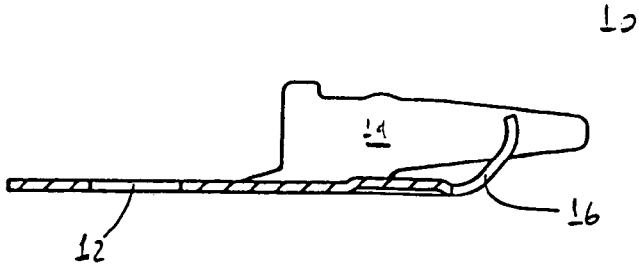
Figure 2C:
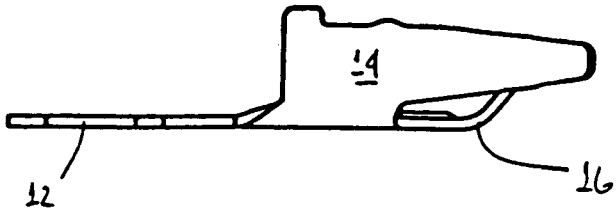
Figure 2D:
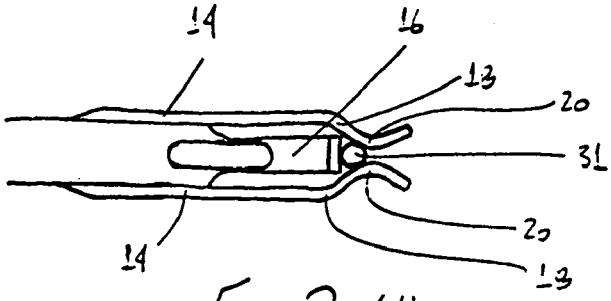

A preferred embodiment of the inventive electrical contact 10, as shown in the FIG. 1 perspective view, and the FIGS. 2(*a*) through 2(*c*) top and side views, has a body section 12, two arms 14 integrally formed along each side of the body section 12, and a center section 16 integrally formed at one end of the body section 12. The center section 15 is formed at one end of the body section 12 and extends into the area between the two arms 14. The arms 14 are formed to extend along a portion of each side of the body section 12 and to extend beyond the end of the body section 12. The end of the body section 12 that is opposite from the arms 14 is typically connected to a circuit board (not shown).

The arms 14 each have an elbow section 18 such that downstream of the elbow sections 18, the arms 14 extend towards each other as shown in FIG. 2(*a*). For the embodiment shown in FIGS. 2(*a*) through 2(*c*), the elbow sections 18 are located on the arms 14 approximately adjacent to the end of the center section 16 such that, in combination, the volume defined by the elbows 18 and the end of center section 16 form a lead cavity 25 into which the electrical component lead 31 is to be placed. FIG. 2(*d*) shows a partial top view of a preferred embodiment of the electrical contact 10, with an electrical component lead 31 in place in the lead cavity 25.

The structural shape of the center section 16, as shown in FIGS. 1 and 2(*a*), is such that it extends between the arms 14. As shown in more detail in FIG. 2(*b*), the center section 16, in a preferred embodiment, may curve away from the plane of the body section 12 to form a cantilever section between the arms 14.

As shown in FIG. 2(*d*), a component lead 31 is held in the lead cavity 25 within the electrical contact 10 by three points of contact. The center section 16, and the two arms 14 each have a point of contact with the component lead 31. Each of the three points of contact also establishes a separate current path between the component lead 31 and the contact 10. Accordingly, in the shown preferred embodiment of the inventive electrical contact three separate and distinct current paths exist between the electrical component and the printed circuit board to which the component is to be attached. Moreover, as shown in FIG. 2(*d*), the three separate current paths are distributed across the cross-section of the component lead 31. For example, for the FIG. 2(*d*) preferred embodiment, the three points of contact are approximately equi-distant about the circumference of the component lead 31. The distribution of current paths across the component lead cross-section provides an additional level of robustness in the electrical connection between the contact 10 and the component lead 31.

An additional feature of the present inventive electrical contact is the lead cavity 25 (formed by the arms 14 and the center section 16 and having an approximate triangular shape (see FIG. 2(*a*)), accommodates component leads of varied cross sections. While the FIG. 2(*d*) embodiment shows a circular cross section for the component lead 31, a square, rectangular, oval or other lead cross section would easily fit in the lead cavity 25 between the arms 14 and the center section 16. No matter what component lead cross section is provided, the inventive electrical contact has three points of contact with the component lead.

An objective of all electrical contacts is to establish and maintain a sound electrical connection between the contact and the lead to which it is attached. The force exerted by the contact on the lead is one aspect of the electrical connection. It has been discovered for the preferred embodiment shown in FIGS. 1 through 2(*d*) that a normal force of approximately 50 grams applied by each of the arms 14 and the center section 16 to the component lead 31 is generally sufficient to establish a sound electrical connection. The normal force is the force imparted to the component lead perpendicular to the surface of the component lead. Although 50 grams of normal force is sufficient for good electrical connections, in other equally effective preferred embodiments, the normal force applied by the three sections of the contact 10 to the component lead 31 may be approximately in the range of 60 to 120 grams.

The selection of the forces applied to the component lead 31 by the contact 10, or more particularly, applied by the arms 14 and center section 16, may be made through design and selection of the flexibility or elastic characteristics for the center section 16 and the arms 14. In a preferred embodiment of the inventive three point contact, the elbow sections 18 may be fabricated to have a particular spring constant or force per distance elastic characteristic. That is, for a higher spring constant, a larger force will be imparted to the component lead 31 by the arm 14. Similar to making the arms 14 with particular flexible force characteristics, the center section 16 similarly could be made in whole or in part to have a design spring constant.

Spring constants approximately in the range of 20 to 150 grams per thousandths of an inch (grams/mil) have shown good force characteristics and provided sound electrical connections. While too low a spring constant may result in an insufficient force being applied by the contact arms 14 or the center section 16 to the component lead 31, the force characteristics should not be chosen to be excessive. If a very high spring rate is chosen such that very large forces are required to move the arms 14 to allow the component lead 31 into the lead cavity 25, the potential exists that the component lead may deform or material may be scraped away from the lead. For the typical electronics application, the component leads have a very small diameter, being approximately in the range of 0.010 to 0.025 inches. Moreover, the component leads, in certain applications are manufactured with a gold covering or plating. Accordingly, if the force characteristics of the contact are designed to be too high, the very small component leads may be deformed or damaged, which could adversely affect functional performance of the component and circuit.

One preferred embodiment of the inventive spring contact that has shown good force characteristics and strong electrical connections uses a higher spring constant for the center section 16 than for the arms 14. However, other equally effective embodiments use similar spring constant characteristics for both the center section 16 and the arms 14.

In addition to altering the spring constant or spring coefficient of the center section 16 or the arms 14 to select the appropriate force characteristics of the spring contact 10, the direction of the force imparted by the arms 14 to component lead 31 as shown in FIG. 2(*d*) may also be altered by changing the angle at which the elbows 18 direct the arms 14 toward each other. As the angle of the elbow 18 increases, the force imparted by the arms 14 urging the component lead 31 towards the center section 16 also increases. By way of example, if the elbows 18 only very slightly directed the arms 14 towards each other, then the direction of the force imparted by the arms to the lead would approximately be towards the opposite arm. On the other hand, if the elbows 18 sharply directed the arms 14 towards each other, then the direction of the force imparted by the arms 14 would primarily be towards the center section 16. That is, the steeper the angle that the arms 14 are directed towards each other downstream of the elbow 18, the larger the force that urges the component lead 31 towards the center section 16.

In the preferred embodiment shown in FIGS. 1, and 2(*a*) through 2(*c*), the arms 14 have a second elbow section 20 further downstream from the first elbow sections 18 such that the arms 14 extend away from each other after the second elbow sections 20. As shown in this configuration, the contact 10 approximately resembles the shape of a traditional clothespin. With the arms 14 separated at their end, the placement of the electrical component lead 31 into the lead cavity 25, as shown in FIG. 2(*d*), is facilitated.

While different materials may be used from which to fabricate the spring constant, in one preferred embodiment, the contact 10 may be manufactured of a phosphor bronze material.

The present inventive three point spring contact may be used to connect many different electrical components, having at least one lead, to circuit boards. Simply by way of illustration, and not to be limiting, two particular embodiments of inventive electrical contact assemblies using the three point spring contact are disclosed below.

Laser Pump Contact Assembly Embodiment

Figure 8A:
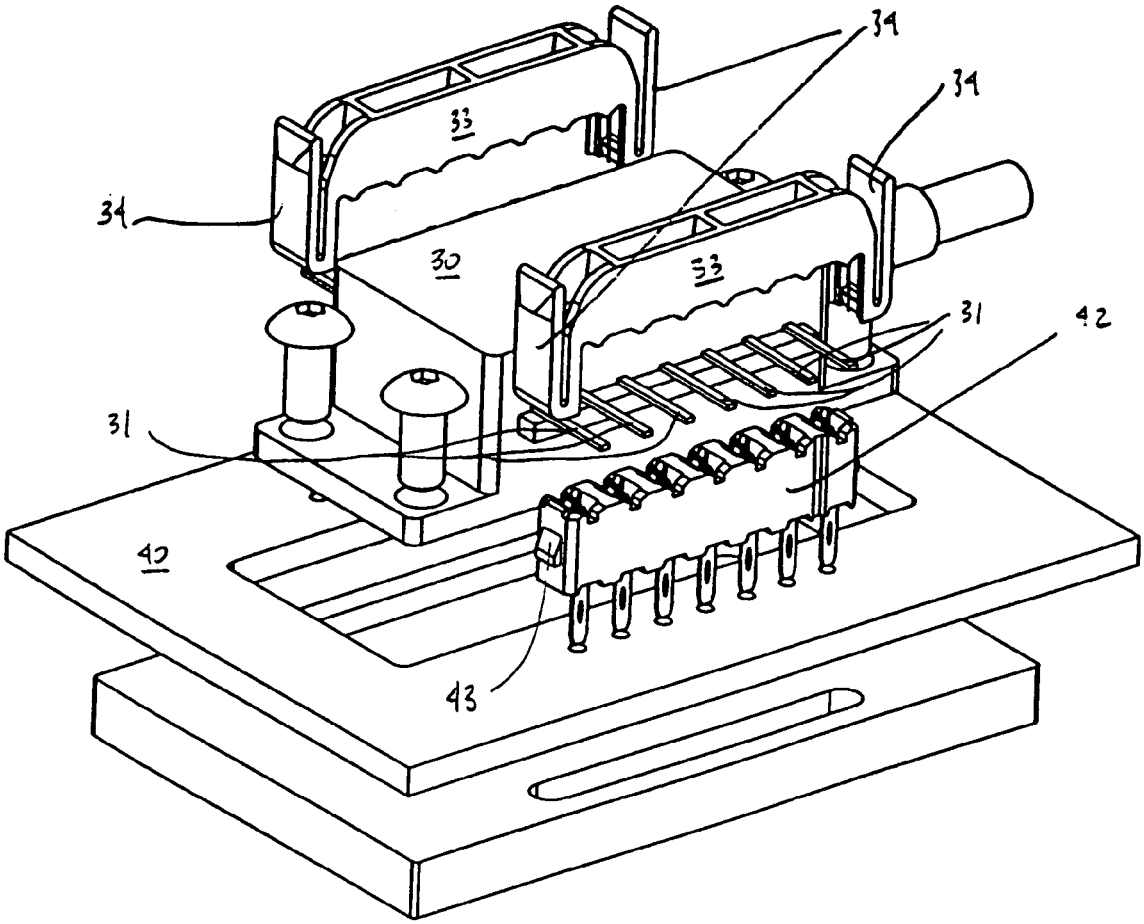
FIG. 8(*a*) is a perspective, exploded view of exemplary embodiments of the present inventive electrical contact assembly housing, with a plurality of three point spring contacts, and covers, with an example laser pump.
Figure 8B:
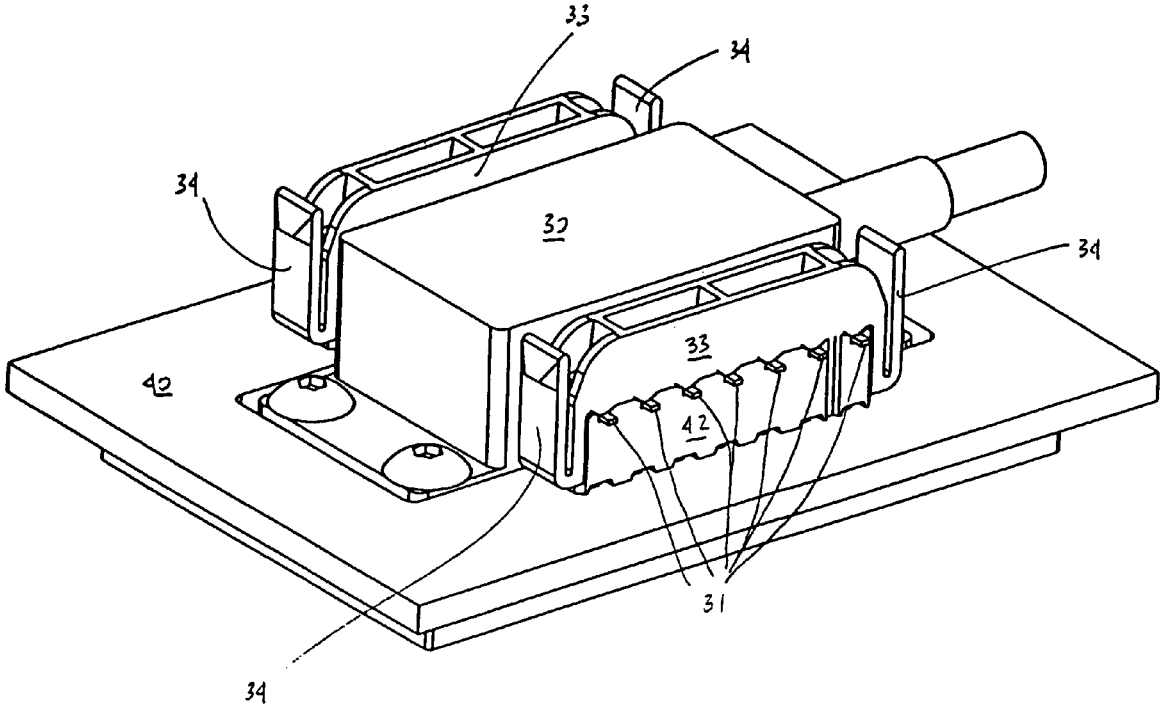

One example of a component that may be interconnected to a circuit board by the spring contact of the present invention is an electrical laser pump . The laser pump has a plurality of cantilever component leads extending from either side of the laser pump in a butterfly like configuration. For this embodiment of the present inventive electrical contact assembly, the three point spring contacts are seated within a housing, and the laser pump component is similarly seated into a separate housing sized and shaped to accommodate the laser pump. FIGS. 8(*a*) and 8(*b*) respectively show perspective views of an embodiment of a laser pump assembly, in an exploded-unassembled condition, and an assembled configuration.

Figure 3A:
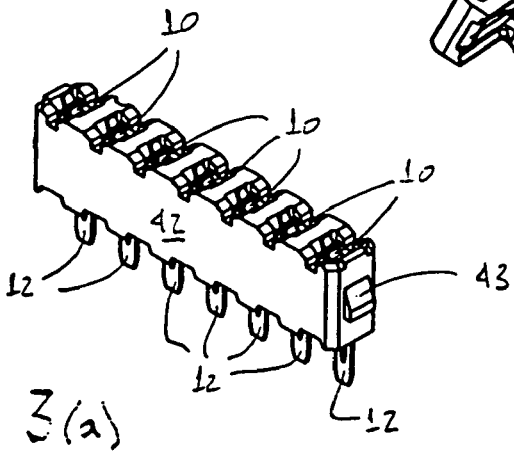
FIG. 3(*a*) is a perspective view of an exemplary embodiment of a plurality of the present inventive three point spring contacts seated within an exemplary embodiment of an electrical contact assembly housing.
Figure 3B:
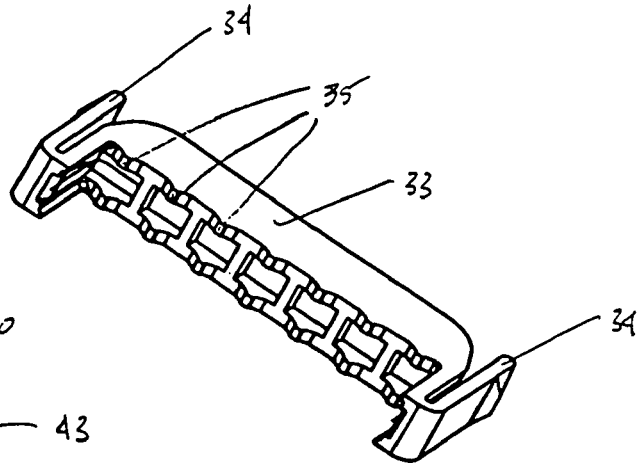
Figure 5A:
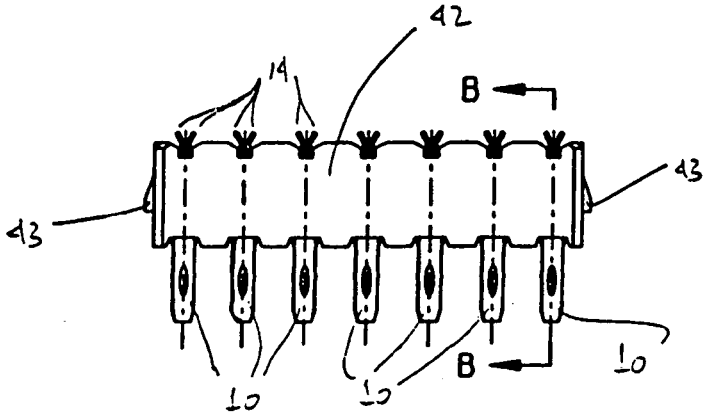
FIG. 5(*a*) is a side view of an exemplary embodiment of a plurality of the present inventive three point spring contacts seated within an exemplary embodiment of an electrical contact assembly housing.
Figure 5B:
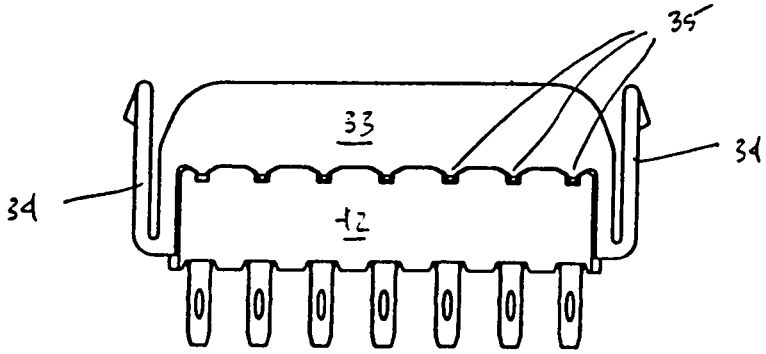
Figure 5C:
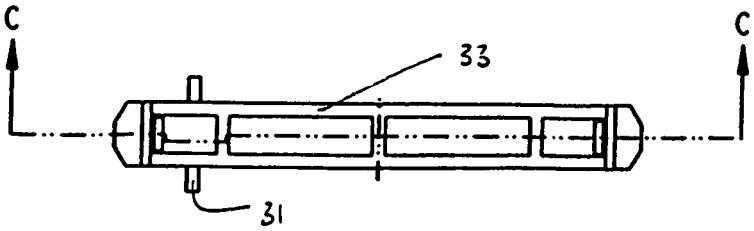

An embodiment of the housing 42 into which the spring contact is seated is shown in a perspective view in FIG. 3(*a*). For the example laser pump 30 shown in FIGS. 8(*a*) and 8(*b*), there are seven component leads extending from each side of the laser pump 30. Accordingly, the contact housing 42 has seven slots for the spring contacts 10, there being one contact 10 for each component lead 31. As shown in FIGS. 3(*a*) and 5(*a*), the body section 12 of the contact 10 extends through the housing 42 for attachment to the circuit board to which the laser pump 30 is to be assembled. When completely seated in the contact housing 42, the top of the contacts 10 protrude above the housing 42, as shown in FIG. 5(*a*) so that the component leads 31 may be pressed into their respective position between the contact arms 14 and into the lead cavity 25. Once pressed into place, each component lead 31 is held by the forces of the spring contact 10 imparted by the arms 14 and the center section 16, as described above.

Figure 4:
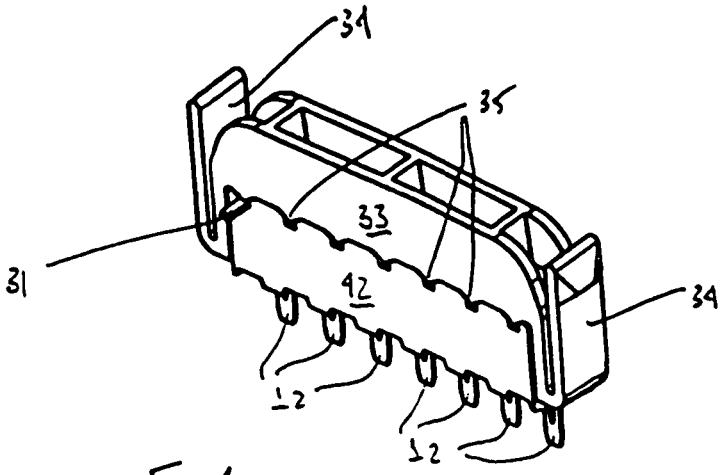
FIG. 4 is a perspective view of the FIG. 3(*a*) electrical contact assembly housing and FIG. 3(*b*) cover completely mated.

Because in this laser pump embodiment, the component leads 31 and the top portion of the spring contact 10 are exposed, a housing cover 33 may be used to protect the leads 31 and the contacts 10. A preferred embodiment of a housing cover 33 which may be used with the disclosed laser pump package is shown in FIG. 3(*b*). The housing cover 33 not only shields a portion of the component leads 31 and the tops of the contact 10 when in place over the housing 42, but may also be designed to ensure that the leads 31 stay in place in the contact 10, and more particularly in the lead cavity 25. The embodiment of the cover 33 shown in FIG. 3(*b*) provides an example design with a plurality of nodes 35 shaped and positioned to fit into the contact openings in the housing 42. As more particularly shown in FIG. 4, once the component lead 31 is seated in the contact 10, the cover 33 may be placed over the housing 42 and the cover nodes 35 fit over and engage the component leads 31.

Figure 6:
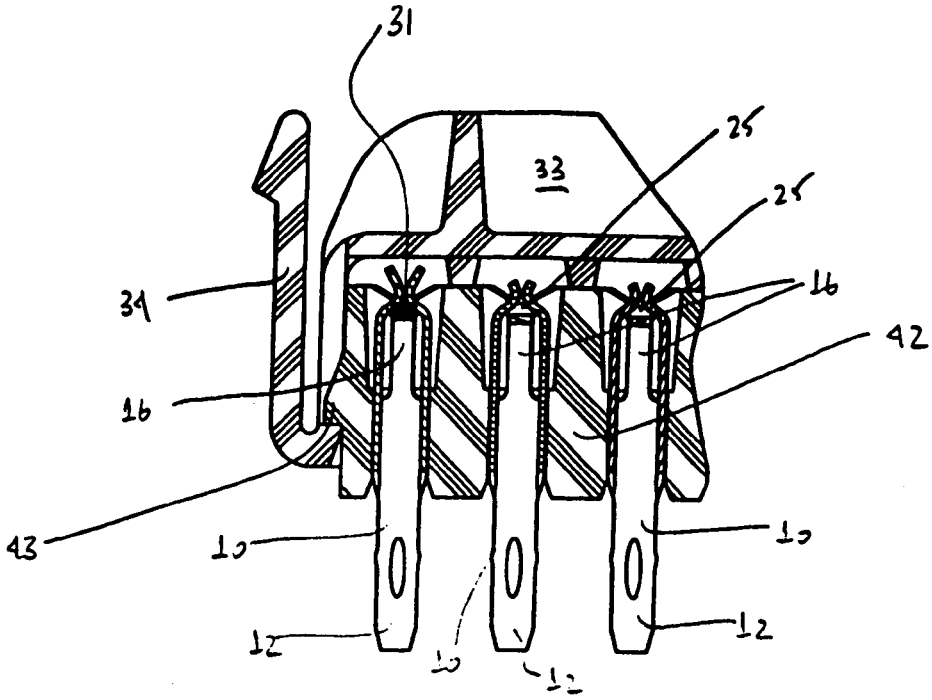
FIG. 6 is a partial side cutaway view of section C—C from FIG. 5(*c*) for an exemplary embodiment of the FIG. 5(*a*) electrical contact assembly housing and completely mated cover.
Figure 7:
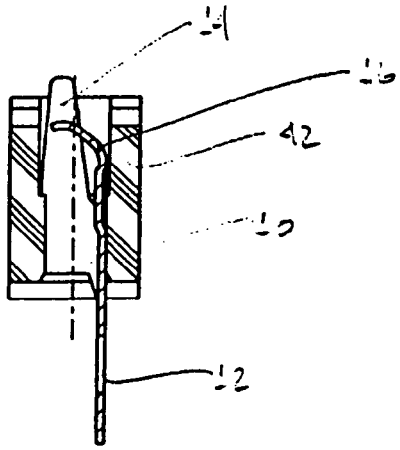
FIG. 7 is an end cutaway view of section B—B from FIG. 5(*a*) for an exemplary embodiment of the FIG. 5(*a*) electrical contact assembly housing.

To further ensure the laser pump leads 31 are protected and maintained in the preferred position in the contacts 10, the cover 33 may also have flexible clips 34 which engage with step catches 43 provided on the sides of the housing 42. FIGS. 5(*a*) and 6 show a side view and a cut away partial side view of the housing 42 and the catches 43. FIG. 5(*b*) and FIG. 6 also show the housing 42 with the cover 33 in place over the housing 42. The nodes 35 fit respectively into each contact location. The cover 33 may be removed from the housing 42 by simply squeezing the flexible clips 34 to release them from each catch 43. FIG. 5(*c*) shows a top view of the cover 33 and shows the C—C view presented in the cutaway side view of the housing 42 and the cover 33 shown in FIG. 6. A more detailed internal view of a contact 10 seated within housing 42 in shown in FIG. 7 (view B—B noted in FIG. 5(*a*)). The FIG. 7 cutaway view shows the elements of the contact 10, including center section 16 and one of the two arms 14.

As shown in more detail in FIGS. 8(*a*) and 8(*b*), the laser pump may be easily installed to a circuit board by pressing the laser pump into place in its housing 40, such that the component leads respectively engage the contacts 10 seated in the housing 42. Once in place, the cover 33 may be pressed into place over the housing 42 to protect the laser pump leads 31 and the contacts 10. If the laser pump needs to be removed or replaced, the cover 33 may be removed by squeezing the clips 34 towards each other to disengage each clip 34 from the catches 43. The laser pump 30 may then be lifted out of its housing 40 and the laser pump leads 31 are pulled away from the contacts 10.

Laser Diode Contact Assembly Embodiment

Another example of the present inventive electrical contact assembly using the inventive spring contact is for a laser diode. Similar to the above described laser pump assembly, the laser diode has multiple component leads 31 and, to ensure solid attachment to a circuit board, a housing sized and shaped to hold the laser diode.

Figure 9:
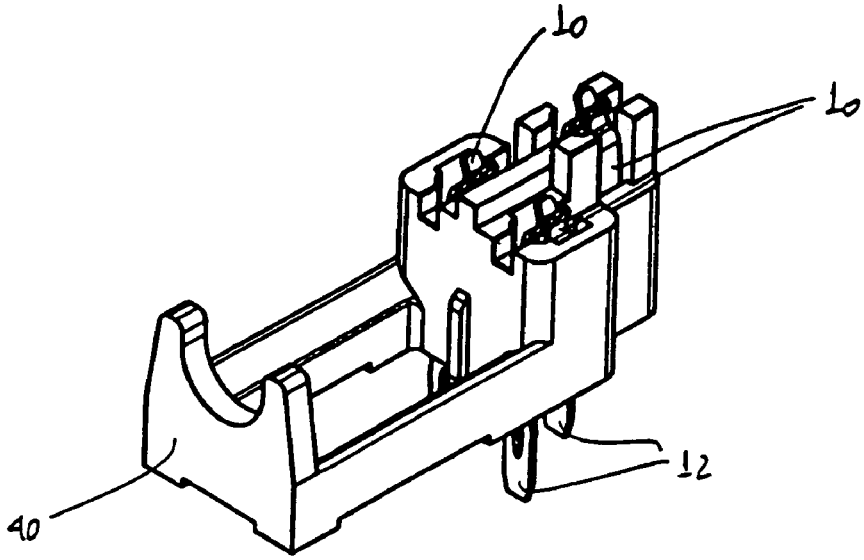
FIG. 9 is a perspective view of another exemplary embodiment of a plurality of the present inventive three point spring contacts seated within another exemplary embodiment of an electrical contact assembly housing.
Figure 11:
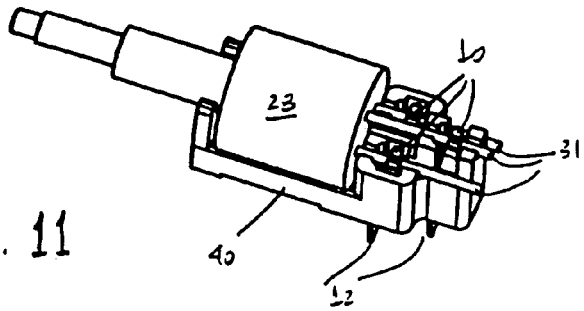
FIG. 11 is a perspective view of an assembled exemplary embodiment of the present inventive electrical contact assembly housing with a plurality of the present inventive three point spring contacts and in which an example laser diode is seated.
Figure 12:
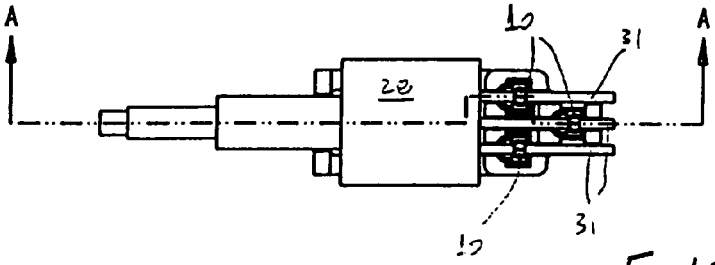
FIG. 12 is a top view of an assembled exemplary embodiment of the present inventive electrical contact assembly housing with a plurality of the present inventive three point spring contacts and in which an example laser diode is seated.
Figure 13A:
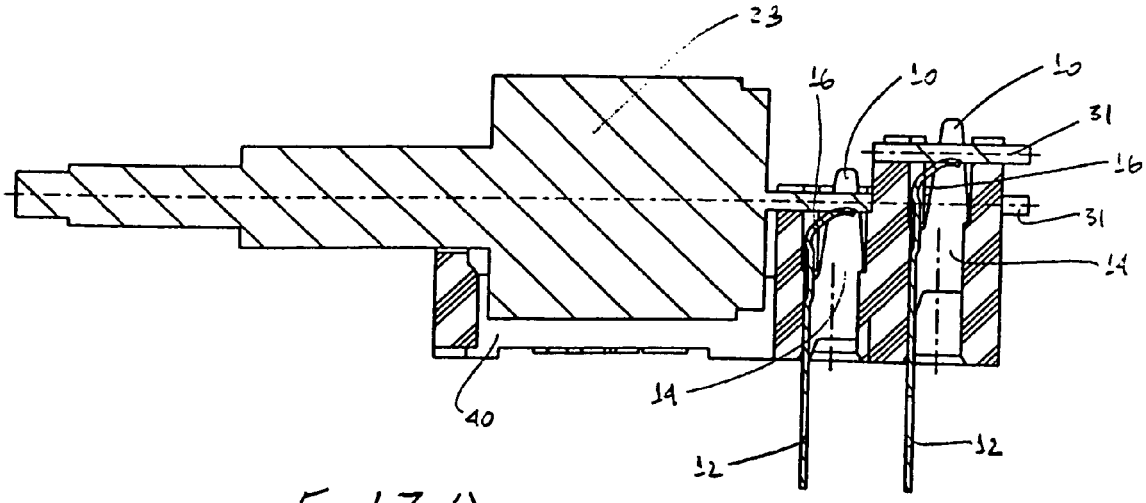
FIG. 13(*a*) is a side cutaway view of section A—A from FIG. 12 for an exemplary embodiment of the present inventive electrical contact assembly housing with a plurality of the present inventive three point spring contacts and in which an example laser diode is seated.

As shown in FIG. 9, an embodiment of a housing 40 sized and shaped for a laser diode 28 having three electrical leads, has three locations where the contacts 10 are seated. Because the housing 40 is to be attached to a circuit board, as shown in FIG. 9, the contact body sections 12 extend through the housing 40, and are to be attached to the circuit board. FIGS. 11 through 13(*a*) show a preferred embodiment of a laser diode assembly with a laser diode 28 installed into the housing 40. As shown, the laser diode leads 31 are seated in position in the contacts 10, and more particularly in the lead cavity 25. The cutaway side view of the laser diode embodiment shown in FIG. 13(*a*), being the A—A view noted in FIG. 12, shows the seated position of the contacts 10 with each center section 16 engaged against respective laser diode leads 31. As shown in FIG. 13(*a*), unlike the laser pump assembly, certain components may require different size contacts to accommodate different locations of component leads. More particularly, for the FIGS. 12 and 13(*a*) embodiment, the contact 10 connected with the middle lead, being the contact 10 on the right hand side of FIG. 13(*a*), has a longer body section 12 than the other two contacts because the location of the two outside components leads are closing to the bottom of the laser diode 28.

Figure 10:
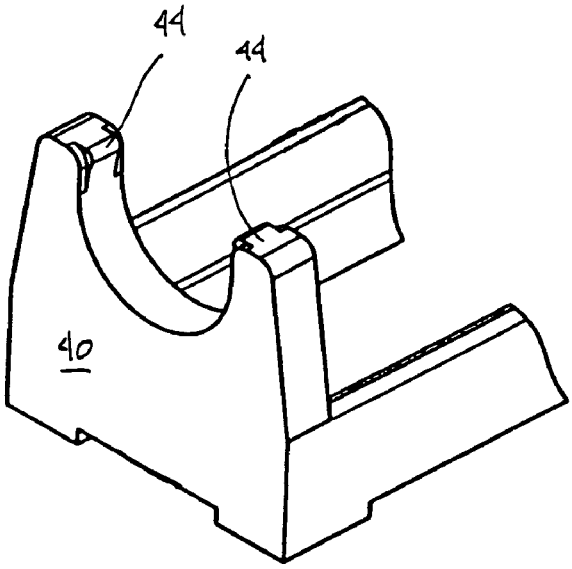
FIG. 10 is a partial perspective view of an exemplary embodiment of an electrical contact assembly housing with ridges formed in the assembly housing.

While the disclosed embodiment of a laser diode assembly shown in FIGS. 9 through 13(*a*) does not use a cover, as shown in the above laser pump assembly, there is still a need to ensure the laser pump 28 is held in place within the housing 40. For the preferred embodiment of laser diode housing 40 shown in FIG. 9, ridges 44 maybe formed on the housing 40, as shown in FIG. 10, such that once the laser diode 28 is pressed into place in the housing 40, a set of ridges 44 apply a retaining force to the laser diode body to hold the laser diode 28 in the housing 40.

Figure 14:
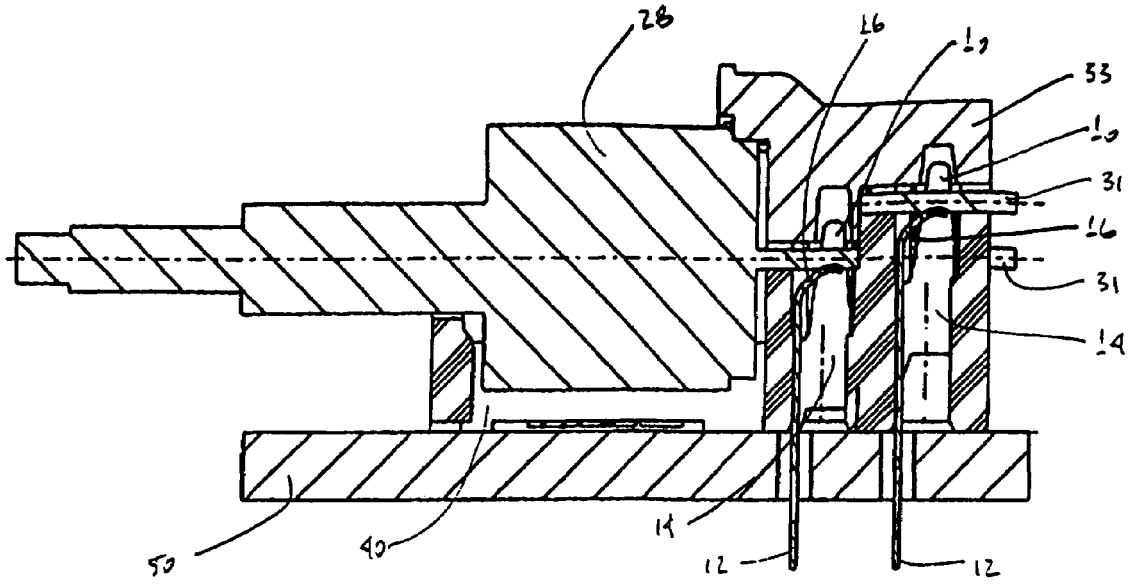
FIG. 14 is a perspective view of an exemplary embodiment of the cover section shown in FIG. 13(*b*) covering the spring contacts and laser diode leads.
Figure 14:
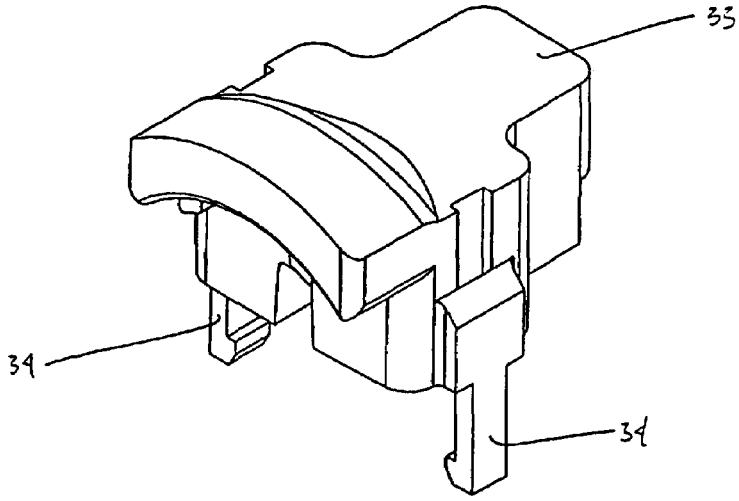

In another preferred embodiment of the laser diode assembly, as shown in FIG. 13(*b*) and FIG. 14, a cover 33 may be used to provide protection for the leads 31 and the contacts 10. For the shape of the preferred embodiment of the cover shown in FIGS. 13(*b*) and 14, the cover 33 also holds the laser diode 28 in place, as shown in the side cutaway view of FIG. 13(*b*). In order to hold the cover 33 in place over the laser diode 28 and laser diode leads 31, the cover may be formed with flexible clips 34 located on both sides of the cover, as shown in FIG. 14, that latch into the housing 40. FIG. 13(*b*) also shows how the laser diode assembly sits on the printed circuit board 50 and that the body section 12 of the spring contacts 10 extends through the board 50. As shown, the laser diode 28 and its component leads 31 are securely held in the housing 40 and spring contacts 10, and is protected from inadvertently being dislodged from the spring contacts 10 due to vibration or physical shock.

Figure 15:
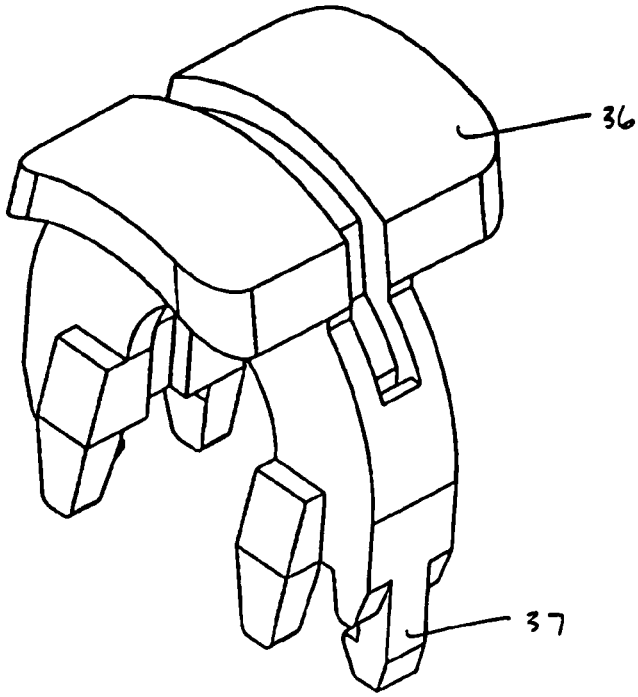
FIG. 15 is a perspective view of an exemplary embodiment of a retaining cover to hold an electrical component within a component housing.
Figure 16:
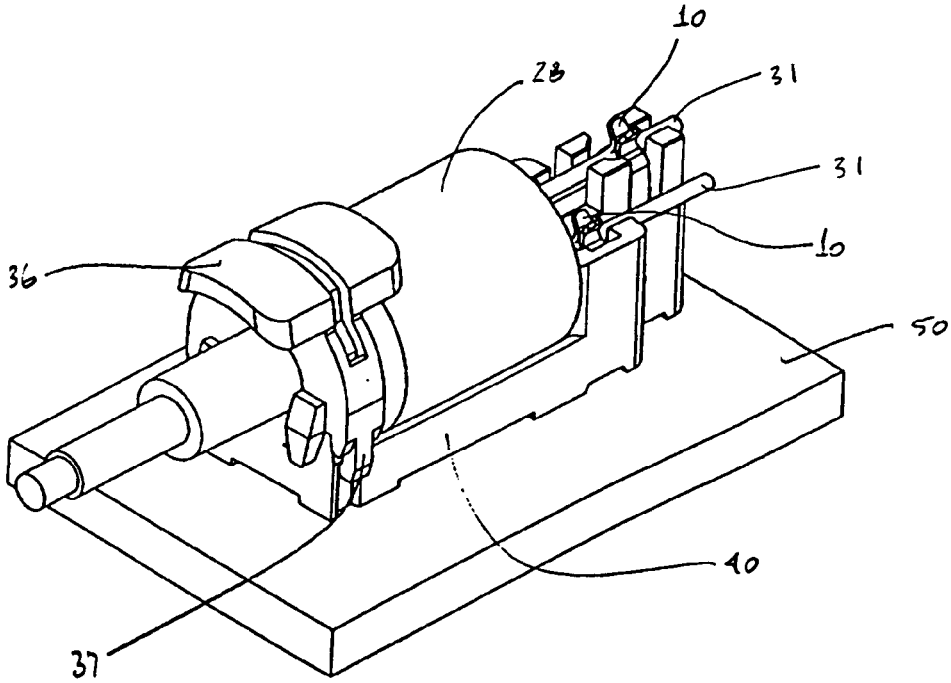
FIG. 16 is a perspective view of an exemplary embodiment of the present inventive electrical contact assembly housing with a plurality of the present inventive three point spring contacts, in which an example laser diode is seated and showing the retaining cover of FIG. 15 in place over the laser diode.

As an alternative preferred embodiment for the laser diode housing 40 shown in FIG. 10, a retaining cover 36 could be used to hold the laser diode 28 in place in the housing 40. FIG. 15 shows an exemplary embodiment of a retaining cover 36 that is sized and shaped to fit over the laser diode 28 and provide a retaining force to the laser diode an hold it within the housing 40. The FIG. 15 embodiment of a retaining cover 36 is shown in place over a laser diode in FIG. 16. The embodiment of the retaining cover shown in FIGS. 15 and 16 has flexible clips 37 that engage into either side of the housing 40, similar to the above described clips 34, which allow the cover 36 to be clipped into place and then easily removed by pulling the clips 34 away from the housing 40. Although it is not shown in FIG. 16, both retaining covers 33 and 36 (as shown in FIGS. 14 and 15) could be used to cover and protect the component leads 31 as well as to hold the laser diode in place within the housing 40.

Figure 17A:
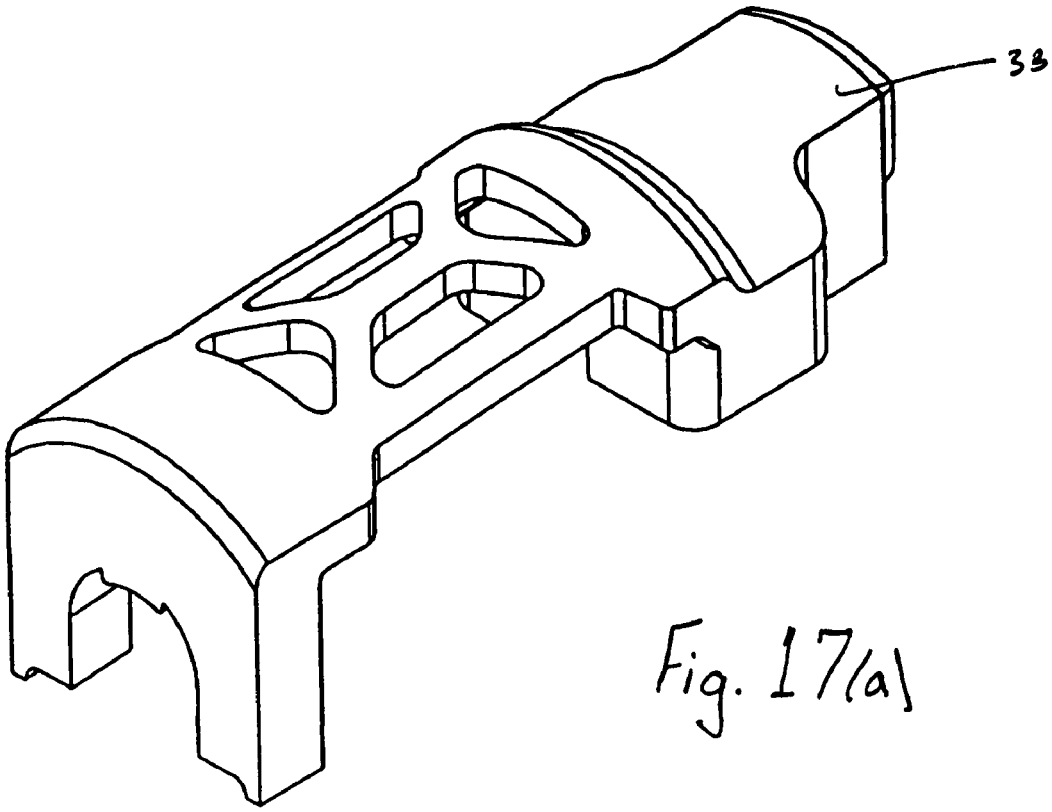
FIG. 17(*a*) is a top perspective view of another exemplary embodiment of a retaining cover to hold an electrical component within a component housing.
Figure 17B:
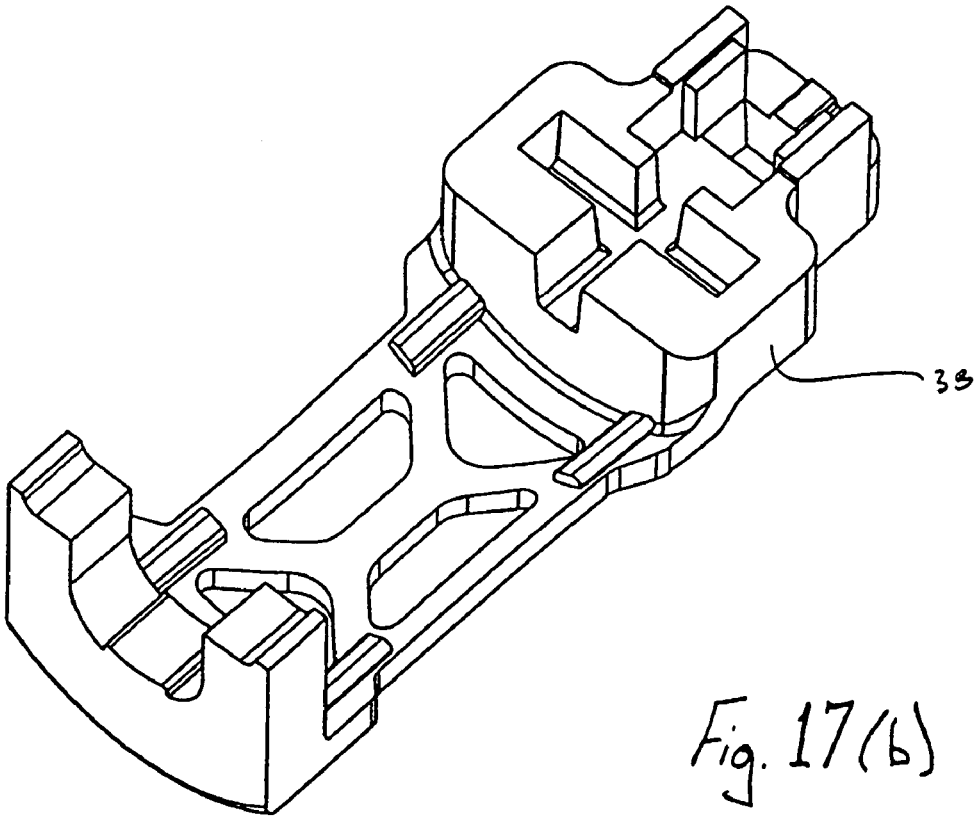
Figure 18:
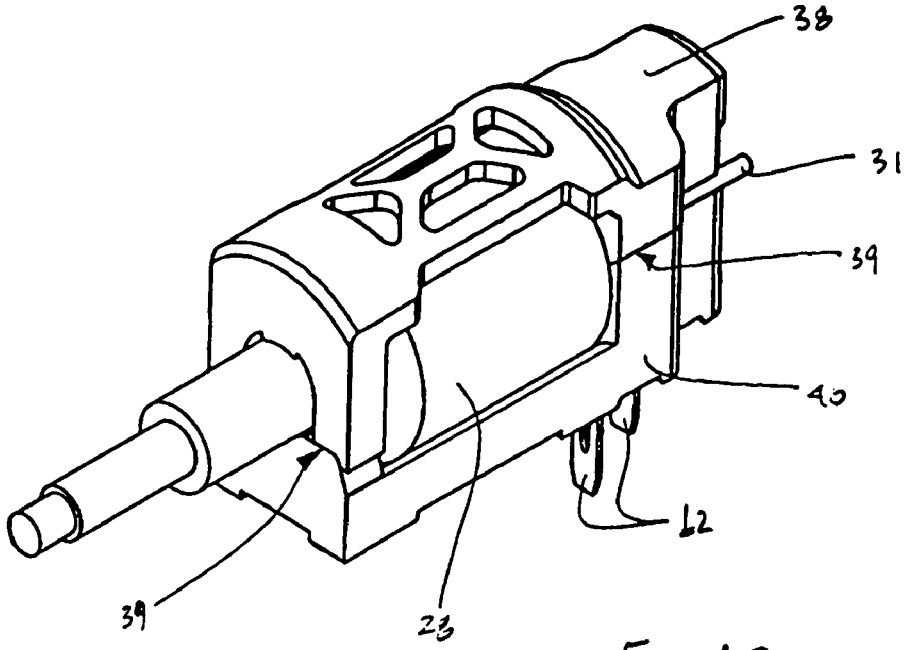
FIG. 18 is a perspective view of an exemplary embodiment of the present inventive electrical contact assembly housing with a plurality of the present inventive three point spring contacts, in which an example laser diode is seated and showing the retaining cover of FIGS. 17(*a*) and 17(*b*) in place over the laser diode.

In yet another preferred embodiment, the electrical component may be completely covered and held in place by a cover section. Such a retaining cover 38 for a laser diode is shown in top and bottom perspective views in FIGS. 17(*a*) and 17(*b*). This preferred embodiment of a retaining cover extends the length of the laser diode and covers the component leads and spring contacts. As shown in FIG. 18, the cover 38 may be sized and shaped to fit over the electrical component, in this embodiment a laser diode 28, and precisely engage the component housing 40.

Figure 19:
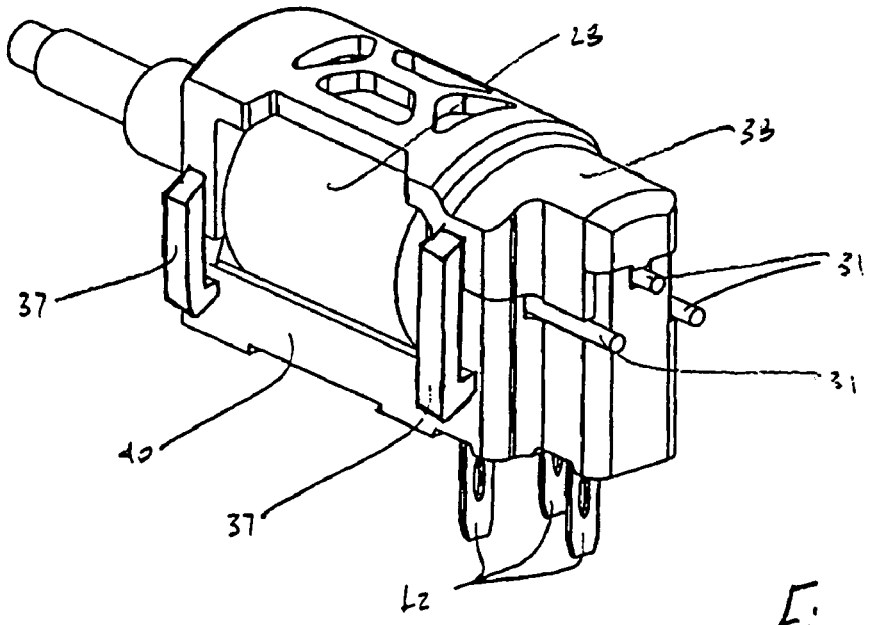
FIG. 19 is a perspective view of an exemplary embodiment of the present inventive electrical contact assembly housing with a plurality of the present inventive three point spring contacts, in which an example laser diode is seated and showing a retaining cover with retaining clips in place over the laser diode.

In one preferred embodiment, the cover 38 and housing 40 may have double sided adhesive (not shown) along the surfaces 39 where the cover 38 and housing 40 join. In another preferred embodiment, shown in FIG. 19, the cover 38 may have flexible clips 37, similar to the above described flexible clips, that engage the sides of housing 40 and hold the laser diode 28 in place in the housing 40.

Similar to the above described laser pump assembly, the laser diode package shown in FIGS. 11, 13(*a*), 13(*b*), 16, 18 and 19 may be easily installed to a circuit board by pressing the laser diode into place in its housing 40. As pressed into place, the three laser diode electrical leads 31 respectively engage the contacts 10 also seated in housing 40. If at some time the laser diode needs to be removed or replaced, it may easily be lifted out of the housing 40 and the laser diode leads 31 accordingly pulled out of the contacts 10. As described, with a cover in place, the laser diode, component leads and spring contacts have added protection and are secured from unintentionally being dislodged due to shock or vibration.

Although the invention has been described with reference to exemplary embodiments, it is not limited thereto. For example, while disclosure of use of the inventive spring contact and contact assembly has been made for a laser pump package and laser diode package, the spring contact may also be used with other electrical components. Accordingly, it is intended to be and understood that the following claims should be construed to include other variants and embodiments of the invention which may be made by those skilled in the art as being within the true spirit and scope of the present invention.

What is claimed is:

1. An electrical spring contact for use with varied electrical components comprising a lead, said spring contact comprising:

(a) a body section, said body section being attachable at one end to a circuit board;

(b) two arms attached to opposite sides of the body section, said two arms defining a separation therebetween and an entry into said separation, said arms each comprising an elbow section extending each arm towards the opposite arm;

(c) a center section attached to the body section between the two arms having an end extending proximate to said two arms elbow sections wherein the center section end and the two elbows form a cavity adapted to:

(i) engage said electrical component lead inserted through said entry approximately in an orthogonal orientation relative to the body section between the center section and the two arms by contacting said lead in three places along a circumference of said electrical component lead at approximately a common transverse cross-section thereof, and (ii) to provide an electrical connection between said electrical component lead inserted in said cavity and said electrical spring contact; and (d) a housing surrounding at least a portion of said body section and said arms, adapted to permit orthogonal insertion of said lead in said cavity through said entry.

2. The electrical spring contact according to claim 1, wherein the two arms each have a second elbow, downstream of the first elbow, extending each arm away from the opposite arm.

3. The electrical spring contact according to claim 1, wherein the center section is a cantilever segment extending between the two arms.

4. The electrical spring contact according to claim 1 wherein the center section and the two arms are electrically conductive.

5. The electrical spring contact according to claim 1, wherein the two elbow sections have a spring constant such that the arms each provide a force against the electrical component lead thereby urging the lead against the center section.

6. The electrical spring contact according to claim 5, wherein the two arms and center section each provide a force approximately greater than 50 grams to the component lead held between the center section and the two arms.

7. The electrical spring contact according to claim 1, wherein the center section is an elastic cantilever segment.

8. The electrical spring contact according to claim 7, wherein the flexible center cantilever segment has a spring constant approximately in the range of 20 to 150 grams/mil.

9. The electrical spring contact according to claim 1 wherein the separation between the two arms is reduced downstream of the elbow sections.

10. The electrical spring contact according to claim 9, wherein the electrical spring contact is adapted to hold an electrical component lead having an approximate square cross section and further said component lead having electrical current paths with each of the center section and two arms.

11. The electrical spring contact according to claim 9, wherein the electrical spring contact is adapted to hold an electrical component lead having an approximate circular cross section and further said component lead having electrical current paths with each of the center section and two arms.

12. The electrical spring contact according to claim 11, wherein the electrical spring contact is adapted to hold an electrical component lead having a diameter approximately in the range of 0.010 inches to 0.025 inches.

* * * * *